United States Patent [19]

Niskin

[11] 3,970,156

[45] July 20, 1976

[54] WATER WEIGHTED CORER

[75] Inventor: Shale Jack Niskin, Miami, Fla.

[73] Assignee: The United States of America as represented by the Secretary of the Navy, Washington, D.C.

[22] Filed: Sept. 15, 1975

[21] Appl. No.: 613,703

[52] U.S. Cl. ..... 175/6; 175/58; 114/206 R; 173/DIG. 1; 60/DIG. 9

[51] Int. Cl.[2] ..... E21B 7/12

[58] Field of Search ..... 114/206 R, 206 A; 175/5, 6, 58; 73/84; 294/66 R; 173/DIG. 1; 60/DIG. 9

[56] References Cited

UNITED STATES PATENTS

| | | | |
|---|---|---|---|
| 3,479,830 | 11/1969 | Ostarly | 114/206 R X |
| 3,561,546 | 2/1971 | Craig | 175/5 |
| 3,561,547 | 2/1971 | Pullos | 175/6 |
| 3,604,519 | 9/1971 | Chelminski | 175/6 |

*Primary Examiner*—Ernest R. Purser
*Assistant Examiner*—Richard E. Favreau
*Attorney, Agent, or Firm*—R. S. Sciascia; L. I. Shrago; C. E. Vautrain, Jr.

[57] ABSTRACT

A water-weighted corer comprising a cylindrical tank mounted concentrically on a core barrel intermediate the coring tube and the shackle is provided. The tank has a water inlet at its bottom and an air vent at its top so that during descent water enters the tank through the bottom inlet, forcing air out the top vent. During free fall the falling speed imparts a substantial amount of kinetic energy to the water mass in the tank, providing the driving force required for the corer to penetrate deeply into a sediment bed.

7 Claims, 4 Drawing Figures

WATER WEIGHTED CORER

The present invention concerns marine sediment corers and, more particularly, a corer in which the required driving force is imparted by an entrapped volume of water.

Marine sediments generally are collected by either of three basic forms of bottom samplers, coring tubes, snappers, and dredges. Coring tubes are used to obtain cylindrical core samples of limited length and are essentially steel tubes that are driven into the ocean floor. A typical coring device consists of interchangeable coring tubes, a main body of streamlined lead weights, and a tailfin assembly that directs the corer in a vertical line substantially normal to the bottom. The amount of sediment collected by coring devices depends upon the length of the corer, the size of the main weight, and the penetrability of the bottom. There are a wide variety of coring devices ranging from those having a manually operated piston to explosively driven corers and pneumatic pistons.

The present invention is directed to a piston corer utilizing the Kullenberg-type piston which heretofore has carried top-weights and has had the length of its coring tube increased to up to 30 meters to obtain a maximum penetration of the bottom. As the length of such corers becomes greater, a greater incidence of disturbed core samples has been noted as well as the frequent occurrence of bent pipes or coring tubes. The latter deficiency is developing into a serious problem since core pipes or tubes are becoming increasingly expensive and difficult to obtain. Another deficiency of the top-weighted piston corer is its intrinsic instability since, while free-falling, this type of corer follows a trajectory which is reversed in attitude so that, depending upon the height of free drop above the bottom, the corer may not have returned to or stabilized at the vertical portion of its lower trajectory when it reaches the bottom. It has been noted that such corers continue to deflect from the vertical even after penetrating the sediment, at first to a significant degree and thereafter to a lesser degree. It is believed that bent core pipes or tubes and, therefore, certain forms of core sample disturbance, are frequently caused by this deflection from the vertical on initial sediment penetration. The present invention avoids the foregoing deflection from the vertical and other disadvantages of top-weighted corers in general by providing during free drop an inherently stable configuration.

Accordingly, it is an object of the present invention to provide a corer which is made inherently stable during the free drop portion of its descent to the bottom.

Another object of this invention is to provide a deep ocean sediment corer which does not require a top weight to provide the corer's driving force.

A further object of the present invention is to provide a deep ocean sediment corer which does not require the mounting and removal of driving weights before and after each operation of the device.

Other objects, advantages and novel features of the invention will become apparent from the following detailed description thereof when considered in conjunction with the accompanying drawings in which like numerals represent like parts throughout and wherein.

In the Kullenberg-type piston corers, a closely fitting piston which is attached to the end of the lowering cable is installed inside the coring tube just above the core catcher. When the coring tube is driven into the ocean floor, friction exercises a downward pull on the core sample while the hydrostatic pressure on the ocean bottom exerts an upward pressure on the core that works against the vacuum being created between the piston and the top of the core. The piston in effect provides a suction that overcomes the friction forces acting between a sediment sample and the inside wall of the coring tube.

The present invention, in general, combines a Kullenberg-type piston corer with a stable recoverable weight disposed vertically thereabove, the combination providing a reusable, inherently stable core sampling device which causes the coring tube to enter the sediment in a substantially uniform, substantially vertical attitude. These features insure that the coring tube or pipe is not bent during entry into the bottom and that a core sample is not disturbed by such bending.

Figure 1:
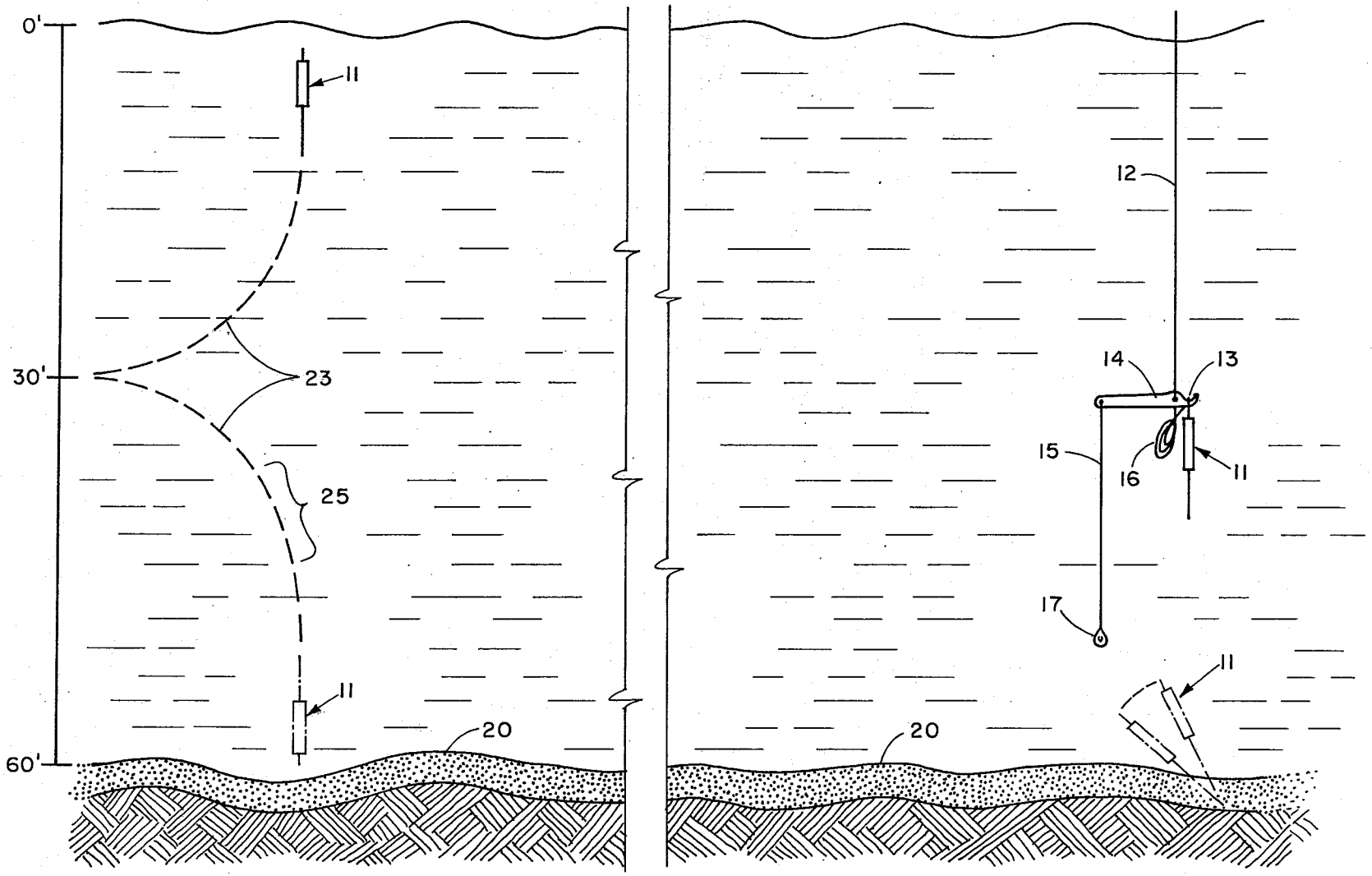
FIG. 1 is a schematic drawing illustrating the operation of conventional top-weighted piston corers.

Referring to the drawings, FIG. 1 is a composite view showing the operation of a conventional top-weighted corer 11 in various stages of suspension and descent to and into the bottom, with the trajectory of such a corer also shown. Corer 11 is shown to the right in FIG. 1 suspended from a cable 12 and a release hook or shackle 13 that is actuable by a tripping beam 14, a trip line 15, a coiled reserve wire 16 and a trip line weight 17. The reserve wire is attached to a Kullenberg-type piston, not shown, and retains the piston at the surface of the bottom as the corer penetrates the bottom. In the lower right portion of FIG. 1, corer 11 is shown at some of the attitudes which may be assumed upon entering and being supported by the bottom which is indicated at 20. To the left in FIG. 1, corer 11 is shown before and after it follows a trajectory 23 which it assumes after release. It will be noted that trajectory 23 is followed a sufficient distance to allow corer 11 to enter the bottom in a substantially perpendicular attitude. It will be appreciated, however, that corer 11 may be affected in flight by current or other instabilities such that it may enter the bottom in the portion of trajectory 23 indicated at 25 whereby the corer will be diverted from a vertical entry into bottom 20.

Figure 2:
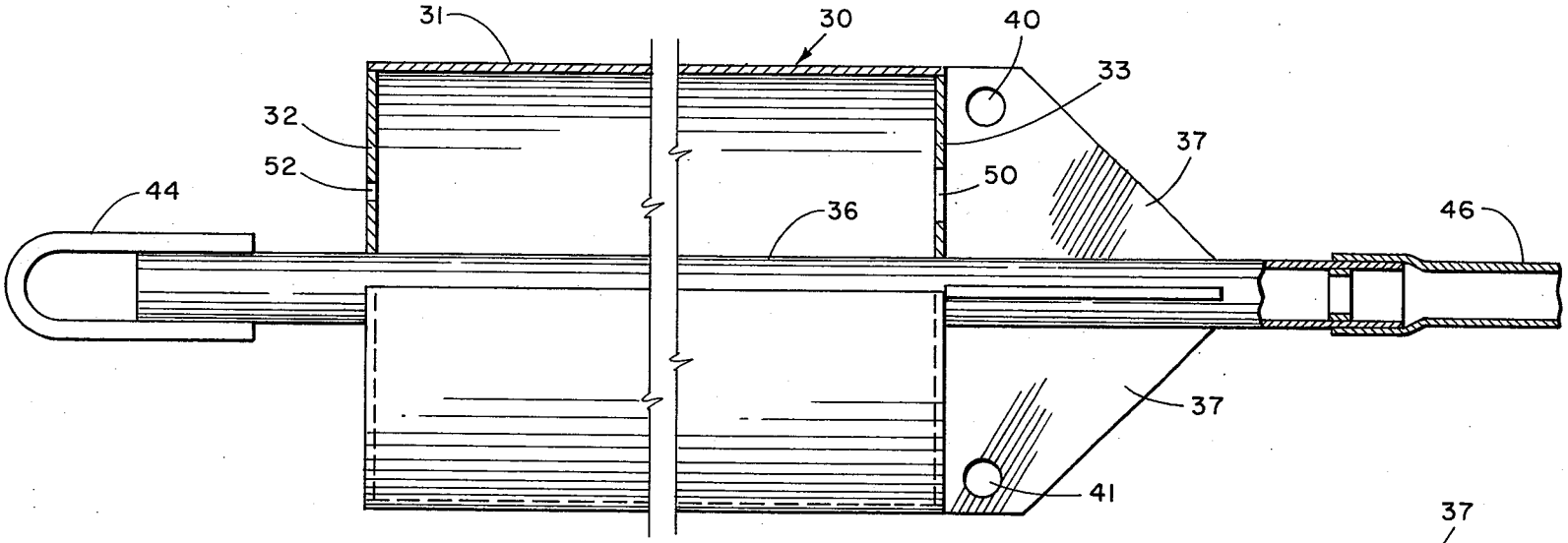
FIG. 2 is a schematic drawing partly in section of a water-weighted piston corer made according to the teachings of this invention.
Figure 3:
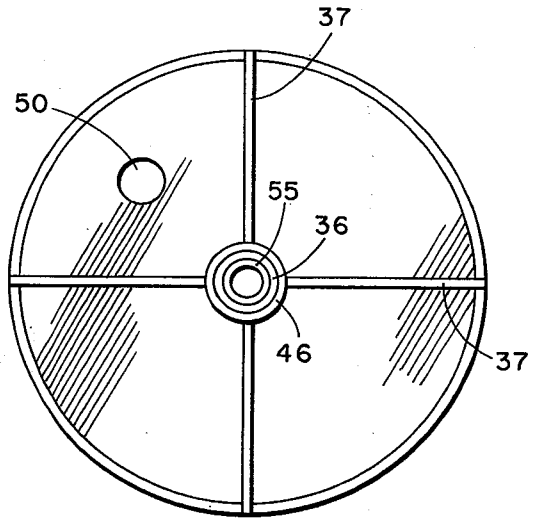
FIG. 3 is an end view of the bottom end of the embodiment of FIG. 1.
Figure 4:
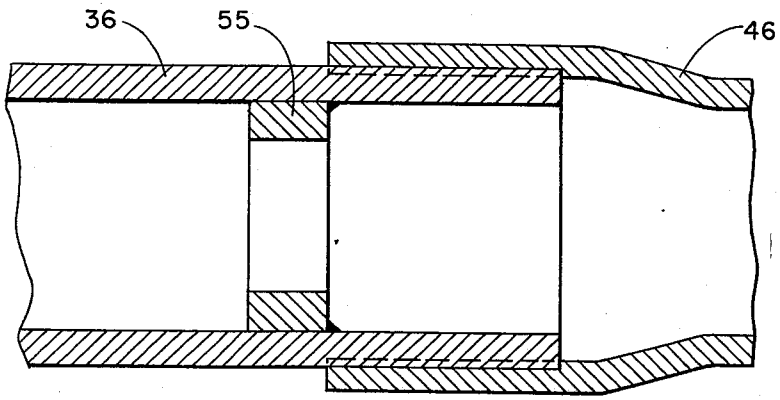
FIG. 4 is an enlarged sectional view of the mating section of the corer tube and the weight supporting standpipe of the embodiment of FIG. 2.

FIGS. 2–4 are various views of one embodiment of a non-top-weighted corer which in FIG. 2 is seen partially in section, in FIG. 3 is seen from the bottom end, and in FIG. 4 is seen in an enlargement of the portion wherein the coring tube is joined to the main body of the device.

The invention essentially consists of a cylindrical tank or other regular closed form 30 which has a complete annular surface 31 and is enclosed by two end plates 32 and 33 which may be other than planar and transverse to the axis of tank 30. Tank 30 is shown as cylindrical for simplicity of construction, but it will be appreciated that various shapes may be adopted within the inventive concept to reduce hydrodynamic drag and otherwise promote stability and accuracy. A standpipe or other cylindrical member 36 extends axially through tank 30, is affixed thereto preferably by welding, and preferably is gusseted to tank 30 by a plurality of gussets 37 to strengthen the structure. Holes 40 and 41 may be provided in the gussets to furnish lifting points for bridles, not shown, during launch and/or recovery. A bail 44 preferably is welded to the top of pipe 36 to suspend the device vertically before release in the medium. The tank in this particular embodiment is fabricated from 60 cm diameter, 9½ mm wall thickness, 2½ meter long steel pipe.

A conventional coupling is shown in the enlargement in FIG. 4 for attaching weighted tank 30 and standpipe 36 to a coring tube or pipe 46. Tank 30 has a water inlet 50 in its bottom closure which has a substantial cross-sectional area in relation to the diameter of standpipe 36 to admit water at a substantial rate during descent, and a substantially smaller opening 52 in the top closure to vent air which the incoming water displaces during descent. The significant difference in size between inlet 50 and opening 52 is desired so as to freely admit water into the tank but to greatly restrict its flow thereout during descent after the air in tank 30 has been vented. Thus, during the greatest portion of the descent of the device, tank 30 is filled with water and, therefore, voids are not an impedement to the rate of descent of the structure which increases with depth as will be discussed infra. A piston stop 55 for stopping a piston of the Kullenberg-type, not shown, is installed in standpipe 36 and acts in the well-known manner in relation to a coring tube liner, not shown, to overcome frictional forces acting between a sediment sample being collected and the inside wall of the coring tube liner. The piston is displaced in response to the core sample entering coring tube liner. This displacement results from the action of the piston whose length and extension is limited so that as coring tube 46 penetrates the bottom, piston is withdrawn thereby creating an area of decreased pressure between it and the top of the core. This decreased pressure overcomes the frictional resistance of the core sample in moving up the coring tube liner and thus permits the collection of noncompressed, uniform samples. Lowering cable 12 is clamped off at the suspension point of attachment to tripping beam 14. The corer free drop distance to the bottom after release is accommodated by wire reserve 16 so that the lowering wire directly attached to the piston runs out just as the corer nose touches the bottom. The piston, initially located at the nose end, remains at the bottom as the corer penetrates the sediment.

The present invention thus provides an improved and less expensive corer for ocean bottom coring which also avoids the disadvantages of top-weighted Kullenberg-type and other conventional samplers. The improvements include reducing the weight necessary to provide the required force for driving the coring tube a selected distance into selected sediments and replacing metal or other solid weights with water. The substitution of a water-filled tank for such top weights avoids inaccuracies caused by the deflection of the top-weighted samplers while providing the required driving force. During free drop, the corer of the present invention is stabilized by the high drag generated by tank 30 which is a function of the large volume of water therein. In addition to correcting vertical orientation and thereby insuring proper entry and easier retrieval, the contained water mass of the corer of this invention contributes to the driving power thereof in the form of accrued kinetic energy. The corer tank is empty during launch and, therefore, the corer is relatively light and easily handled. The tank empties automatically when withdrawn from the water making recovery an easy and safe operation. Also, there are no weights to handle during launch and recovery so that shore and shipboard procedures are made safer and faster.

Theoretical calculations have been made to ascertain the penetration potential and optimum free-drop distances for maximum kinetic energy at the point of impact of the present coring tube with the bottom. To determine the height of corer release necessary for maximum penetration, the following calculations have been made. The equation of motion for a solid object falling freely in water is:

$$(m + m') \frac{d^2x}{dt^2} = -{}^{C}D \frac{dx}{dt}^2 + W_B \qquad (1)$$

Where $m$ is the mass of the falling body, $m'$ is the added mass of the body, ${}^{C}D$ is the drag coefficient and ${}^{W}B$ is the weight in water of the falling body. The assumption is made that the drag coefficient and the added mass are constant. With zero initial velocity, the time required for the corer to reach terminal velocity is about 3.5 seconds, implying a minimum necessary release height of 11½ meters for the corer to develop maximum kinetic energy. Although the added water mass of the corer is dissipated during penetration, the kinetic energy at the initial moment of impact is the same as if physical weights had been added to the corer. The result is a very light corer with a penetration equal to that of corers many times heavier. Of a group of six sediment cores taken with the tank corer of the present invention, including three of thirty meters in length, all were successfully recovered with no bending of the core tubes. Sediment penetration for these corers was somewhat less than for a conventional piston corer having over 1100 kilograms of top weight, however, the tank corer produced one fifteen-meter core that was filled to its entire length with an undisturbed sediment sample.

There is thus presented a novel method of and means for obtaining ocean bottom cores. Such cores have now become very difficult and expensive to obtain and it is apparent that the present invention alleviates both of these deficiencies of conventional top-weighted corers. There is believed to be no practical size limit to the concept of the invention, i.e. larger tanks may be attached to larger and longer standpipes so that larger diameter coring tubes may be driven into the bottom where the condition of the sediment permits this to be done.

Obviously many modifications and variations of the present invention are possible in the light of the above teachings. For example, the lower end of the water-weighted tank may be conically faired to reduce drag and enhance free-drop, and the major perimeter of the tank may be scalloped, ridged, etc. within conventional manufacturing limits to enhance vertical stability. Where the periphery of the tank body is made in undulatory form, the gussets 37 would be made colinear with adjacent protrusions of the undulatory periphery.

What is claimed is:

1. A non-top-weighted reuseable sediment corer for obtaining core samples at all ocean depths within the scope of available cables comprising:

an enclosed hollow symmetrical body for containing a selected volume of water, said body adapted to become vertically oriented during free fall in water and having a lower surface and an upper surface; and an axial member affixed to and extending through said body and having a bail attached to the upper end thereof and a coring tube attached to the lower end thereof, said hollow body having means in its lower surface for admitting water thereinto and means in its upper surface for allowing the escape of air entrained therein so that the driving force of said corer is substantially provided by a selected volume of water accumulated in said body during the initial phase of launch, said volume of water reducing the non-flooded weight of the corer and added to the stability and driving power thereof, said volume of water emptied by gravity during recovery of said device.

2. The apparatus defined in claim 1 and further including gusset means joining said lower surface to the adjacent portion of said axial member for more securely affixing together said member and said body, said gusset means radially disposed with respect to the longitudinal axis of said axial member and having a base portion which extends a substantial distance axially at the outer dimension of said body.

3. The apparatus defined in claim 2 wherein said body is cylindrical in form and said surfaces extend transverse to the longitudinal axis of said axial member.

4. The apparatus defined in claim 3 wherein said axial member is tubular and further including a piston disposed in said coring tube.

5. A method of rendering free fall coring devices inherently stable and more easily recoverable comprising:

entrapping a selected volume of water in the body of the device by displacing the air in a body chamber with water which is admitted during descent through an opening at the corer end of the device and venting the air through a vent remote from the corer to provide the required driving force for desired sediment penetration of the corer; and jettisoning the volume of water during retrieval of the device, the relative sizes of the water opening and air vent being selected so that the chamber is filled with water during a predetermined distance of fall and the flow of water through the chamber thereafter is severely restricted.

6. An inherently stable free fall coring device comprising:

a body portion for providing the driving force of the device; and structural means centrally disposed in said body portion and including a coring tube attached at the end thereof first entering the water and a bail attached at the end remote from said coring tube, said body portion adapted to receive ambient water therein during the initial phase of free fall, said received water forming substantially the entire weight required to drive said coring tube a selected distance into bottom sediment.

7. The coring device of claim 6 wherein said body portion is a tank and said structural means is a standpipe affixed to said tank, said tank having a symmetrical periphery and top and bottom end closures positioned adjacent said bail and said coring tube, respectively, said bottom closure having an opening therein for admitting ambient water into said tank, said top closure having a vent therein for venting air from said tank.

* * * * *